US010178748B1

(12) United States Patent
Steck et al.

(10) Patent No.: US 10,178,748 B1
(45) Date of Patent: Jan. 8, 2019

(54) X-RAY SPOT STABILITY

(71) Applicant: Moxtek, Inc., Orem, UT (US)

(72) Inventors: Rick Steck, West Jordan, UT (US); Todd S. Parker, Kaysville, UT (US)

(73) Assignee: Moxtek, Inc., Orem, UT (US)

( * ) Notice: Subject to any disclaimer, the term of this patent is extended or adjusted under 35 U.S.C. 154(b) by 147 days.

(21) Appl. No.: 15/455,856

(22) Filed: Mar. 10, 2017

Related U.S. Application Data

(60) Provisional application No. 62/352,334, filed on Jun. 20, 2016.

(51) Int. Cl.

| | |
|---|---|
| ***H01J 35/12*** | (2006.01) |
| ***H05G 1/02*** | (2006.01) |
| ***H01J 35/18*** | (2006.01) |
| ***H01J 35/06*** | (2006.01) |
| ***H01J 35/08*** | (2006.01) |

(52) U.S. Cl.
CPC ..... *H05G 1/025* (2013.01); *H01J 35/06* (2013.01); *H01J 35/08* (2013.01); *H01J 35/12* (2013.01); *H01J 35/18* (2013.01); *H01J 2235/1204* (2013.01); *H01J 2235/1295* (2013.01)

(58) Field of Classification Search
CPC . H05G 1/02; H05G 1/025; H01J 35/02; H01J 35/12; H01J 2235/12; H01J 2235/1204; H01J 2235/1258; H01J 2235/1291; H01J 2235/1295; H01J 2235/167; A61B 6/14; A61B 6/145; A61B 6/4405
See application file for complete search history.

(56) References Cited

U.S. PATENT DOCUMENTS

| | | | | |
|---|---|---|---|---|
| 4,384,360 | A * | 5/1983 | Kitadate | H05G 1/025 378/199 |
| 7,072,439 | B2 * | 7/2006 | Radley | G01N 23/12 378/47 |
| 7,209,545 | B2 * | 4/2007 | Radley | G01N 23/12 378/137 |
| 7,382,856 | B2 * | 6/2008 | Radley | H01J 35/12 378/207 |
| 7,515,684 | B2 * | 4/2009 | Gibson | G01N 23/12 378/44 |
| 9,070,531 | B2 * | 6/2015 | Ueda | H05G 1/025 |
| 9,502,206 | B2 | 11/2016 | Harker et al. | |

(Continued)

*Primary Examiner* — Thomas R Artman
(74) *Attorney, Agent, or Firm* — Thorpe, North & Western, LLP

(57) ABSTRACT

An x-ray tube can provide x-ray spot stability, even for a small x-ray tube. The x-ray tube can have small target displacement, where target displacement is a displacement of the target material, towards the electron-emitter, along a longitudinal-axis of the anode, from x-ray powered-off state to stable operation, based on elongation of the anode. The x-ray tube can include a heatsink with an array of fins extending away from a base in opposite directions. A first fan can be attached to one end of the array of fins, oriented to face the base, and configured to direct an airstream towards the base. A second fan can be attached to opposite ends, oriented to face away from the base, and configured to draw the airstream from the base. Plate(s) can be located on sides of the fins to direct air flow from the first fan to the second fan.

20 Claims, 4 Drawing Sheets

(56) References Cited

U.S. PATENT DOCUMENTS

Figure 1:
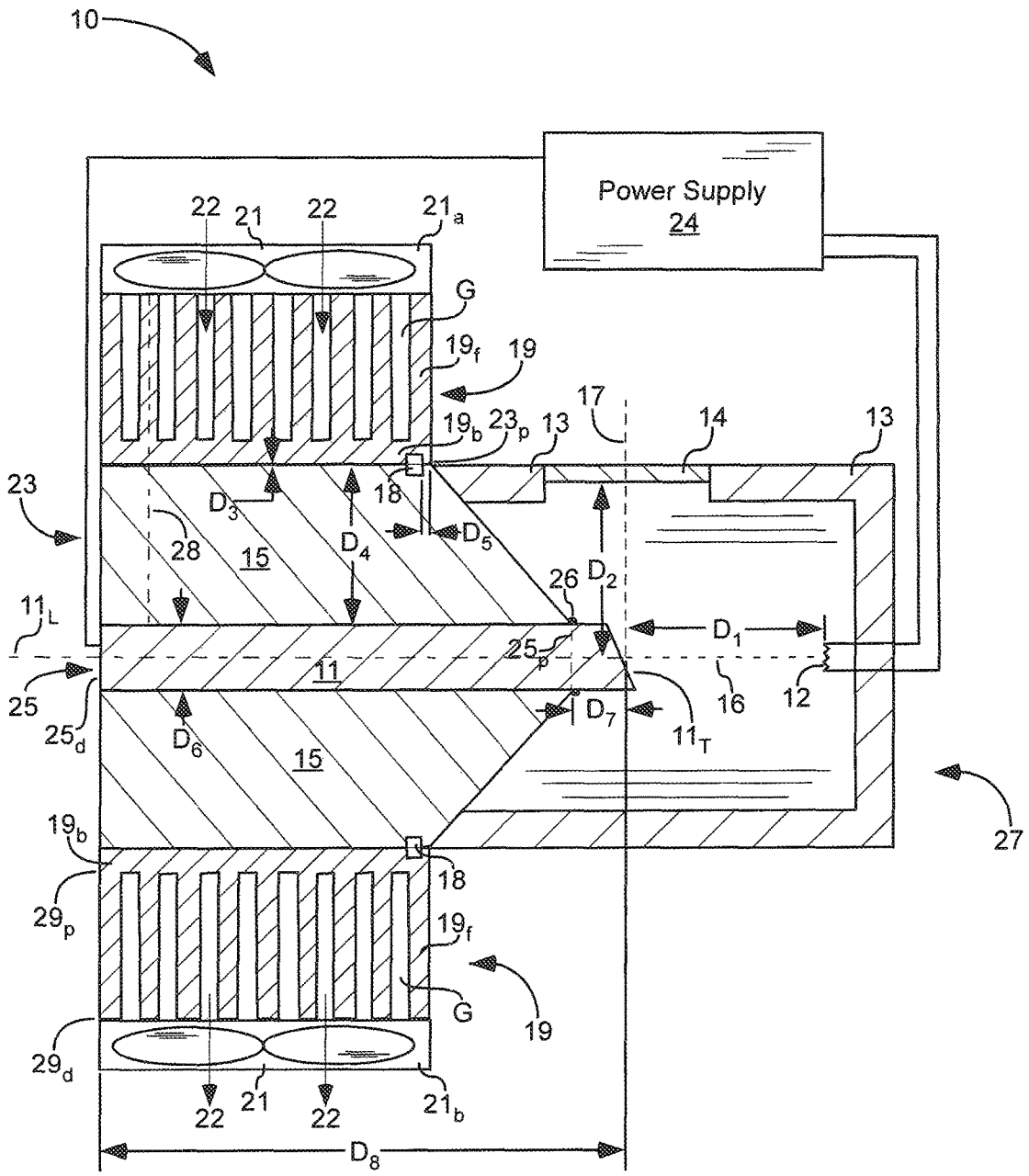

| | | | | |
|---|---|---|---|---|
| 2005/0031073 | A1* | 2/2005 | Radley | G01N 23/12 378/47 |
| 2005/0041773 | A1* | 2/2005 | Gibson | G01N 23/12 378/47 |
| 2005/0053197 | A1* | 3/2005 | Radley | G01N 23/12 378/193 |
| 2007/0140420 | A1* | 6/2007 | Radley | H01J 35/12 378/45 |
| 2017/0094761 | A1* | 3/2017 | Miller | H01J 35/06 |
| 2017/0338076 | A1* | 11/2017 | Hess | H01J 35/12 |

* cited by examiner

X-RAY SPOT STABILITY

PRIORITY CLAIM(S)

Priority is claims to U.S. Provisional Patent Application No. 62/352,334, filed Jun. 20, 2016, which is hereby incorporated herein by reference.

FIELD OF THE INVENTION

The present application is related generally to x-ray tubes.

BACKGROUND

A location where an x-ray beam hits a sample is called an x-ray spot. In some applications, especially if the x-ray source is used with polycapillary focusing optics, it can be important for the x-ray spot to be stable (i.e. does not fluctuate over time). Temperature changes of, and temperature differentials within, the x-ray source can cause instability or fluctuation of the x-ray spot.

It would be beneficial to increase positional stability of the x-ray spot. Large x-ray tubes can have large pathways for removal of heat, but some x-ray tubes (e.g. for a portable x-ray source) need small size, and can't afford large pathways for removal of heat. Therefore, it can be more difficult to provide x-ray spot stability in these small x-ray tubes. X-ray tubes are often cooled by a heat exchanger carrying a liquid coolant. Such a cooling method may be impractical for a portable x-ray source.

SUMMARY

It has been recognized that it would be advantageous to increase positional stability of the x-ray spot, especially for small and portable x-ray sources, and to avoid the need for a heat exchanger. The present invention is directed to various embodiments of x-ray tubes that satisfy these needs. Each embodiment may satisfy one or more of these needs.

The x-ray tube can comprise an anode that is electrically-conductive and that includes a target material configured for production and emission of x-rays in response to impinging electrons; and a cathode, electrically insulated from the anode, and having an electron-emitter capable of emitting electrons towards the target material on the anode.

In one embodiment, the target material can have a target displacement less than 60 micrometers, where the target displacement is a displacement of the target material, towards the electron-emitter, along a longitudinal-axis of the anode, from x-ray powered-off state to stable operation at 40 watts, based on elongation of the anode.

In another embodiment, the x-ray tube can be small. For example, a distance from the electron-emitter to the target material can be less than 40 millimeters and/or a distance from the x-ray window to a center of the target material can be less than 25 millimeters.

In another embodiment, the x-ray tube can include a heatsink with a base located closer to the anode and an array of fins extending from the base away from the anode in opposite directions with first distal ends at one end and second distal ends at an opposite end. A first fan can be attached to the first distal ends of the array of fins, oriented to face the base, and configured to direct an airstream towards the base. A second fan can be attached to the second distal ends of the array of fins, oriented to face away from the base, and configured to draw the airstream from the base. An air flow path can extend from the first fan to the second fan within array of fins. Plates can be located on sides of the fins and can be configured to direct air flow from the first fan to the second fan.

In another embodiment, the x-ray tube can include an electrical-insulator encircling the anode and electrically insulating the cathode from the anode and a heatsink attached to and in thermal contact with the electrical-insulator.

BRIEF DESCRIPTION OF THE DRAWINGS (DRAWINGS MIGHT NOT BE DRAWN TO SCALE)

FIG. 1 is a schematic, cross-sectional side-view of an x-ray source 10, comprising an x-ray tube 27 and a power supply 24, the x-ray tube 27 including a cathode 13, an anode 11, an electrical-insulator 15 encircling the anode 11, a heatsink 19 attached to the electrical-insulator 15, and two fans 21 located at opposite ends of fins $\mathbf{19}_f$ of the heatsink 19, in accordance with an embodiment of the present invention.

Figure 2:
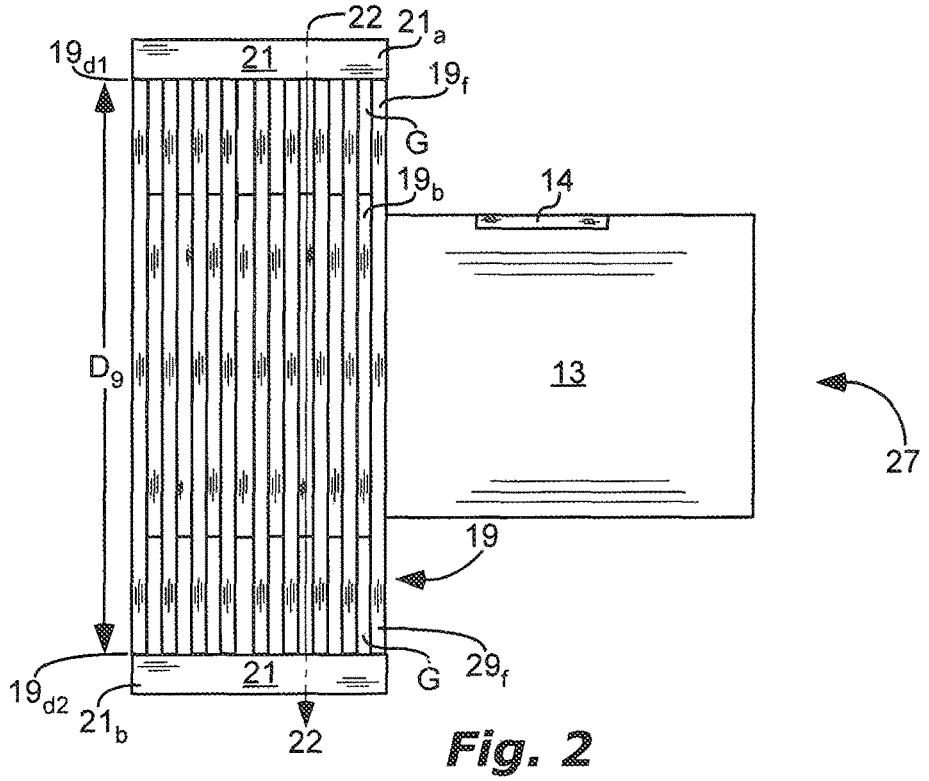

FIG. 2 is a schematic side-view of the x-ray tube 27 of FIG. 1, in accordance with an embodiment of the present invention.

Figure 3:
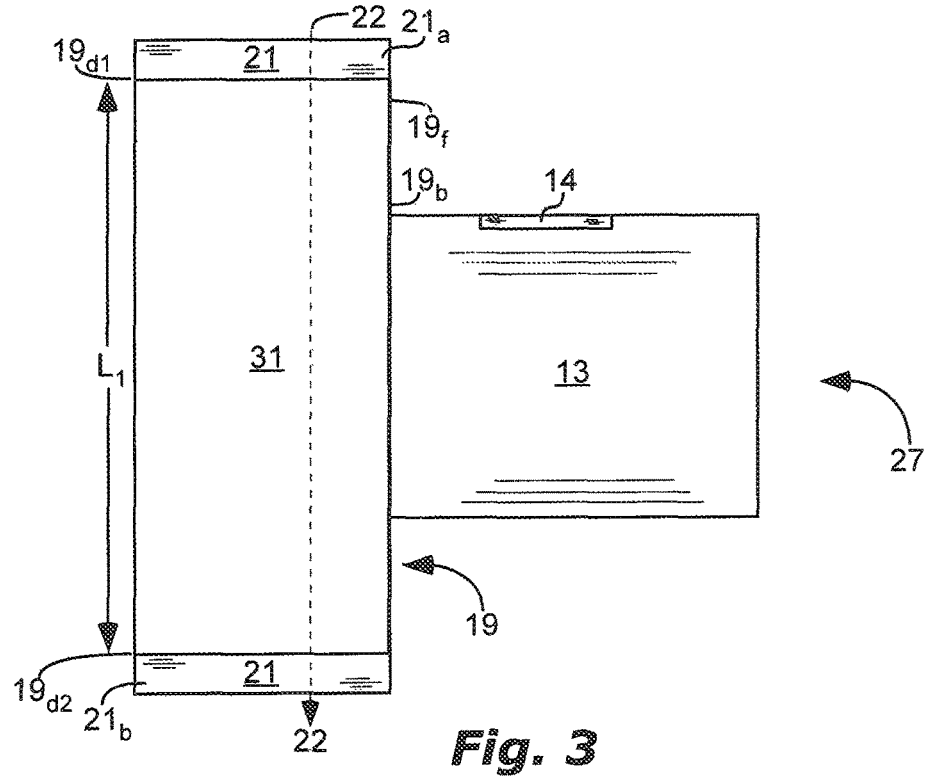

FIG. 3 is a schematic side-view of the x-ray tube 27 of FIG. 2, with a first plate 31 located on a first lateral side $\mathbf{29}_f$ of the fins $\mathbf{19}_f$ and blocking at least a portion of gaps G between the fins $\mathbf{19}_f$ to direct flow from one fan 21 to the other and across a base $\mathbf{19}_b$ of the heatsink 19, in accordance with an embodiment of the present invention.

Figure 4:
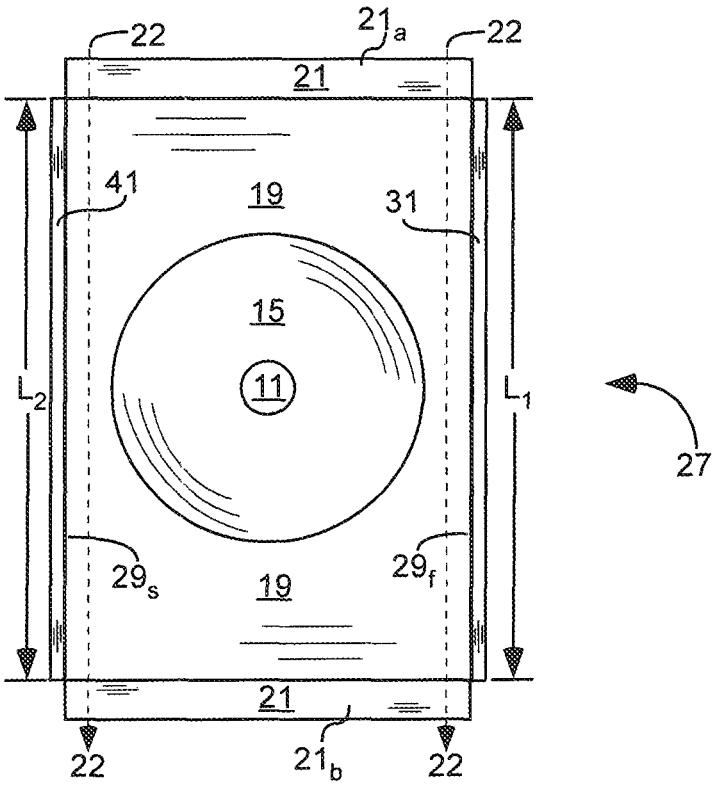

FIG. 4 is a schematic end-view of the x-ray tube 27 of FIG. 3, showing the first plate 31 located on the first lateral side $\mathbf{29}_f$ of the fins $\mathbf{19}_f$, and a second plate 41 located on a second lateral side $\mathbf{29}_s$ of the fins $\mathbf{19}_f$, that is opposite of the first lateral side $\mathbf{29}_f$, and blocking at least a portion of gaps G between the fins $\mathbf{19}_f$ to direct flow from one fan 21 to the other and across a base $\mathbf{19}_b$ of the heatsink 19, in accordance with an embodiment of the present invention.

Figure 5:
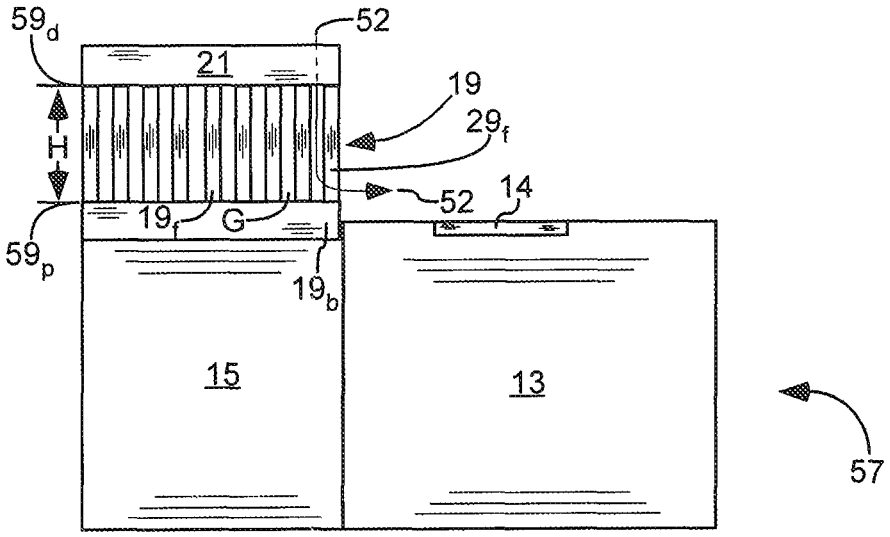

FIG. 5 is a schematic side-view of an x-ray tube 57, similar to x-ray tubes 27 in FIGS. 1-4, except with fins $\mathbf{19}_f$ extending in a single direction away from the base $\mathbf{19}_b$ of the heatsink 19 and only a single fan 21, in accordance with an embodiment of the present invention.

Figure 6:
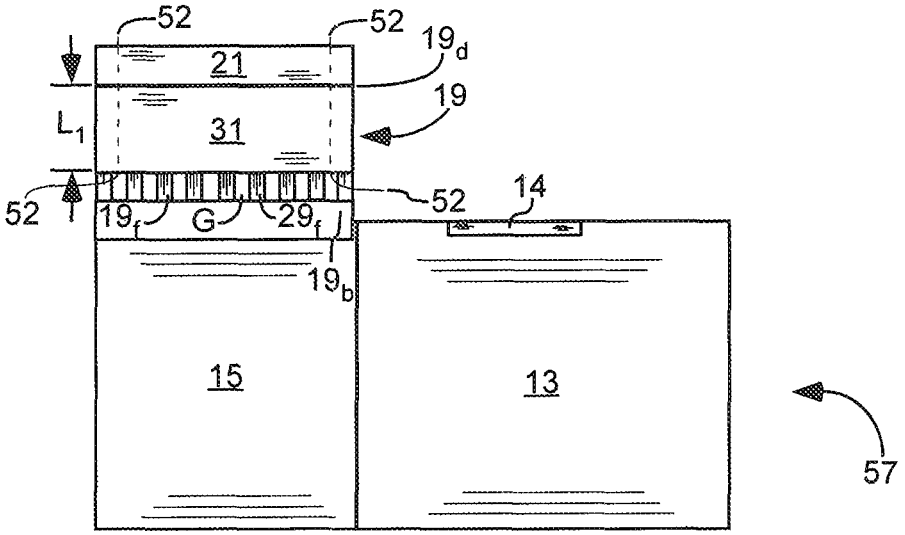

FIG. 6 is a schematic side-view of the x-ray tube 57 of FIG. 5, with a first plate 31 located on a first lateral side $\mathbf{29}_f$ of the fins $\mathbf{19}_f$ and blocking at least a portion of gaps G between the fins $\mathbf{19}_f$ to direct flow from one fan 21 to and across the base $\mathbf{19}_b$ of the heatsink 19, in accordance with an embodiment of the present invention.

Figure 7:
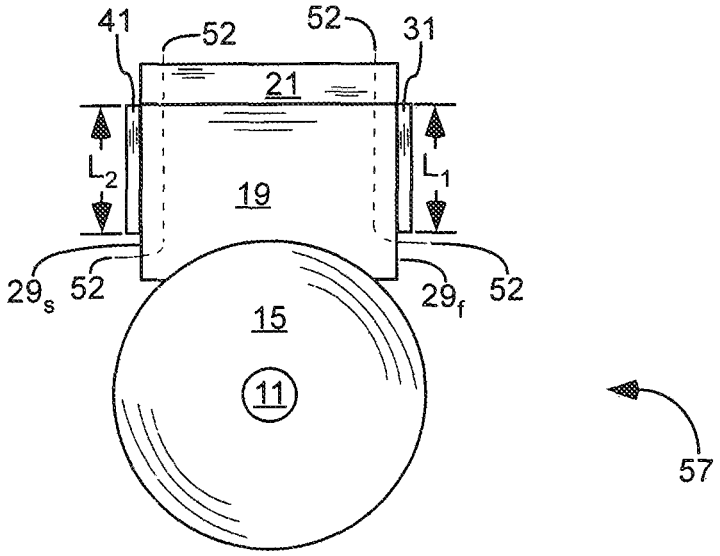

FIG. 7 is a schematic end-view of the x-ray tube 57 of FIG. 6, showing the first plate 31 located on the first lateral side $\mathbf{29}_f$ of the fins $\mathbf{19}_f$, and a second plate 41 located on a second lateral side $\mathbf{29}_s$ of the fins $\mathbf{19}_f$, that is opposite of the first lateral side $\mathbf{29}_f$, and blocking at least a portion of gaps G between the fins $\mathbf{19}_f$ to direct flow from one fan 21 to and across a base $\mathbf{19}_b$ of the heatsink 19, in accordance with an embodiment of the present invention.

DETAILED DESCRIPTION

As illustrated in FIG. 1, an x-ray source 10 is shown comprising a power supply 24 electrically coupled to an x-ray tube 27. Various views and embodiments of the x-ray tube 27, without the power supply 24, are also shown in FIGS. 2-4. X-ray tube 57, shown in FIGS. 5-7, is similar to x-ray tube 27, except for a difference in structure of the heatsink 19, as will be described below. The x-ray tubes 27 and 57 can include an anode 11 and a cathode 13. The anode 11 can be electrically-conductive and can include a target material $11_T$ configured for production and emission of x-rays 17 in response to impinging electrons 16. The cathode 13 can be electrically insulated from the anode 11 and can have an electron-emitter 12 capable of emitting electrons 16 towards the target material $11_T$ on the anode 11.

The x-ray tubes 27 and 57, shown in the figures, are side-window x-ray tubes. The invention may be more useful to side-window x-ray tubes; however, the invention may also be applicable to transmission-target x-ray tubes. In the side-window x-ray tubes 27 and 57 shown in the figures, the x-ray window 14 can be electrically-insulated from the anode 11 and can be electrically-coupled to the cathode 13. The x-ray window 14 can be spaced apart from the target material $11_T$ of the anode 11 and can be located to allow transmission of the x-rays 17 through the x-ray window 14 and out of the x-ray tube 27 or 57. The x-ray window 14 can include some or all of the properties (e.g. low deflection, high x-ray transmissivity, low visible and infrared light transmissivity) of the x-ray window described in U.S. patent application Ser. No. 14/597,955, filed on Jan. 15, 2015, which is incorporated herein by reference in its entirety.

In a side-window x-ray tube, the x-ray spot can change due to expansion and contraction of the anode 11 as the temperature changes. For example, as the anode 11 of x-ray tubes 27 and 57 expand and contract along a longitudinal-axis $11_L$ of the anode 11 the x-ray spot can shift. This can cause problems in some x-ray applications, such as for example if the x-ray tubes 27 and 57 are used with poly-capillary focusing optics.

A change in length ΔL can be described by the following equation: $\Delta L = L_o * \alpha * \Delta T$, where $L_o$ is the original length, α is a coefficient of thermal expansion, and ΔT is a change in temperature. Therefore, the change in length ΔL can be reduced by any or all of the following: reducing the original length $L_o$, reducing the coefficient of linear thermal expansion α, and reducing the change in temperature ΔT. All three of these can be reduced by the invention described herein.

The x-ray tubes 27 and 57 can include an electrical-insulator 15, electrically insulating the cathode 13 from the anode 11 (of course a vacuum also electrically insulates the cathode 13 from the anode 11 along a different potential electrical-current path). The electrical-insulator 15 can be made of various electrically-insulative materials, including ceramic or glass.

A hole 25 can extend through the electrical-insulator 15. The anode 11 can extend partially or completely through the hole 25. There can be a proximal-end $25_p$ of the hole 25 closer to, and a distal-end $25_d$ of the hole 25 farther from, the electron-emitter 12. The original length $L_o$ of the region that affects the change in length ΔL of the anode 11, in regard to motion of the target material $11_T$ and motion of the x-ray spot, is based on a location of attachment of the anode 11 to the electrical-insulator 15. The original length $L_o$, and thus also the change in length ΔL, can be reduced by attaching the anode closer to the proximal-end $25_p$ of the hole 25 of the electrical-insulator 15. Thus for example, a bond (e.g. hermetic-bond) of the electrical-insulator 15 to the anode 11 can be located at the proximal-end $25_p$ of the hole 25 in one aspect, within 3 millimeters of the proximal-end $25_p$ of the hole 25 in another aspect, or within 6 millimeters of the proximal-end $25_p$ of the hole 25 in another aspect.

By bonding or attaching 26 the electrical-insulator 15 to the anode 11 at the proximal-end $25_p$, the original length $L_o$ of the region that affects the change in length ΔL of the anode 11 can be a distance $D_7$ between the center of the target material $11_T$ of the anode 11 and the proximal-end $25_p$. This distance $D_7$ can be small, such as for example less than 20 millimeters in one aspect, less than 10 millimeters in another aspect, or less than 7 millimeters in another aspect. In contrast, if the bond of the electrical-insulator 15 to the anode 11 is at the distal-end $23_d$, the length $L_o$ of the region that affects the change in length ΔL of the anode 11 can be the relatively large distance $D_8$ between the center of the target material $11_T$ of the anode 11 and the distal-end $23_p$.

The change in length ΔL can also be reduced by selection of a material, for part or all of the anode 11, with a relatively small coefficient of linear thermal expansion α at 20° C., such as for example less than 5 μm/(m*K) in one aspect, less than 6 μm/(m*K) in another aspect, or less than 10 μm/(m*K) in another aspect. For example, all or part of the anode can be made of tungsten, with a coefficient of linear thermal expansion α of about 4.5 μm/(m*K) at 20° C.

The change in length ΔL can also be reduced by reducing the change in temperature ΔT during operation of the x-ray tubes 27 and 57. A heatsink 19 can be attached to the electrical-insulator 15. The heatsink can be directly attached to the electrical-insulator 15, such that there is minimal distance $D_3$ between the heatsink 19 and the electrical-insulator 15, such as for example less than 0.1 millimeter in one aspect, less than 1 millimeter in another aspect, or less than 3 millimeters in another aspect.

The heatsink can be directly attached to the electrical-insulator 15 by a material with a high thermal conductivity, such as for example a silver epoxy. Use of an electrical-insulator 15 made of a material with a high thermal conductivity, can also improve heat transfer and reduce the change in temperature ΔT. For example, many ceramics have higher thermal conductivities than potting materials. Thus, the electrical-insulator 15 can be made partly or entirely of ceramic. By use of a ceramic electrical-insulator 15, silver epoxy between the electrical-insulator 15 and the heatsink 19, and a heatsink with a material that has a high thermal conductivity, a straight-line path 28 from an inside of the electrical-insulator 15, proximate the anode 11, through the electrical-insulator 15, through the heatsink 19 to an outer-surface of the heatsink 19, can pass only through materials having a relatively high coefficient of thermal conductivity, such as for example, at least 2.0 W/m*K in one aspect, at least 10 W/m*K in another aspect, or at least 20 W/m*K in another aspect.

Reducing electrical-insulator 15 thickness can also help reduce the change in temperature ΔT. For example, the electrical-insulator 15 can have a thickness $D_4$, from an inner diameter proximate the anode 11 to an outer diameter proximate the heatsink 19, of less than 25 millimeters in one aspect, less than 12 millimeters in another aspect, or less than 10 millimeters in another aspect.

It can be beneficial, especially for portable x-ray sources, if a heatsink with air cooling can be used instead of a heat exchanger with a liquid coolant. Following are options for design of the heatsink 19 for improved heat transfer, to reduce the change in temperature ΔT without use of a heat exchanger with liquid coolant.

The heatsink 19 can have a base $19_b$ proximate the electrical-insulator 15 and an array of fins $19_f$. As shown in FIGS. 1-4, the array of fins $19_f$ can be elongated and can extend outwards away from the electrical-insulator 15 in opposite directions with first distal ends $19_{d1}$ at one end and second distal ends $19_{d2}$ at an opposite end. A first fan $21_a$ can be attached to the first distal ends $19_{d1}$, oriented to face the base $19_b$, and configured to direct an airstream towards the base $19_b$. A second fan $21_b$ can be attached to the second distal ends $19_{d2}$, oriented to face away from the base $19_b$, and configured to draw the airstream away from the base $19_b$.

An air flow path 22 can extend from the first fan $21_a$ to the second fan $21_b$ within array of fins $19_f$. A first lateral side $29_f$ of the array of fins $19_f$ can extend from the first distal ends $19_{d1}$ to the second distal ends $19_{d2}$. A second lateral side $29_s$ of the array of fins $19_f$ can extend from the first distal ends $19_{d1}$ to the second distal ends $19_{d2}$ at an opposite side of the array of fins $19_f$ from the first lateral side $29_f$.

A first plate 31 can be located on the first lateral side $29_f$. The first plate 31 can have a length $L_1$ to block gaps G between the fins $19_f$ on the first lateral side $29_f$. For example, the first plate 31 can have a length $L_1$ of at least 70% in one aspect, at least 80% in another aspect, at least 90% In another aspect, or at least 95% in another aspect, of a distance $D_9$ between the first distal ends $19_{d1}$ and the second distal ends $19_{d2}$ on the first lateral side $29_f$. The first plate 31 can block at least 70% of the gaps G in one aspect, at least 80% of the gaps G in another aspect, at least 90% of the gaps G in another aspect, at least 95% of the gaps G in another aspect. The first plate 31, by its length $L_1$ and location, can thus be configured to direct air flow from the first fan $21_a$ to the second fan $21_b$.

A second plate 41 can be located on the second lateral side $29_s$. The second plate 41 can have a length $L_2$ to block gaps G between the fins $19_f$ on the second lateral side $29_s$. For example, the second plate 31 can have a length $L_2$ of at least 70% in one aspect, at least 80% in another aspect, at least 90% In another aspect, or at least 95% in another aspect, of a distance $D_9$ between the first distal ends $19_{d1}$ and the second distal ends $19_{d2}$ on the second lateral side $29_s$. The second plate 31 can block at least 70% of the gaps G in one aspect, at least 80% of the gaps G in another aspect, at least 90% of the gaps G in another aspect, at least 95% of the gaps G in another aspect. The second plate 41, by its length $L_2$ and location, can thus be configured to direct air flow from the first fan $21_a$ to the second fan $21_b$.

As shown in FIGS. 5-7, the array of fins $19_f$ can be elongated and can extend outwards away from the electrical-insulator 15, from proximal ends $59_p$ at the base $19_b$ to distal ends $59_d$ away from the base $19_b$, and can have a height H extending between the proximal ends $59_p$ and the distal ends $59_d$. A fan 21 can be located adjacent to the distal ends $59_d$ of the array of fins $19_f$ and can be oriented to face the base $19_b$ and can be configured to direct an airstream towards the base $19_b$. An air flow path 52 can extend from the fan 21 at the distal ends $59_d$ of the array of fins $19_f$, along the array of fins $19_f$ to the base $19_b$, and out a first lateral side $29_f$ of the array of fins $19_f$.

A first plate 31 can be located at the first lateral side $29_f$ of the array of fins $19_f$ and can extend from the distal ends $59_d$ of the array of fins $19_f$ towards the base $19_b$. The first plate 31 can have a length $L_1$ designed for optimal size and direction of the air flow path 52 to direct air flow from the fan to the base $19_b$ of the heatsink 19. For example, the length $L_1$ can be at least 25% of the height H of the array of fins $19_f$ in one aspect, at least 50% of the height H of the array of fins $19_f$ in another aspect, at least 75% of the height H of the array of fins $19_f$ in another aspect, or at least 90% of the height H of the array of fins $19_f$ in another aspect.

As shown in FIG. 7, in addition to the first plate 31, a second plate 41 can be located at a second lateral side $29_s$ of the array of fins $19_f$. The second lateral side $29_s$ can be opposite of the first lateral side $29_f$. The second plate 41 can extend from the distal ends $59_d$ of the array of fins $19_f$ towards the base $19_b$. The second plate 41 can have a length $L_2$ designed for optimal size and direction of the air flow path 52 to direct air flow from the fan to the base $19_b$ of the heatsink 19. For example, the length $L_2$ can be at least 25% of the height H of the array of fins $19_f$ in one aspect, at least 50% of the height H of the array of fins $19_f$ in another aspect, at least 75% of the height H of the array of fins $19_f$ in another aspect, or at least 90% of the height H of the array of fins $19_f$ in another aspect.

Displacement of the target material $11_T$ can be reduced by a design that includes elements as just described, such as one or more of: (a) reducing a length $L_o$ the anode 11 (or at least reducing a portion of the anode 11 that can affect target material $11_T$ location by thermal expansion and contraction); (b) reducing the coefficient of linear thermal expansion $\alpha$; and (c) improving heat transfer to reduce the change in temperature $\Delta T$. For example, the target material $11_T$ can have a target displacement less than 100 micrometers in one aspect, less than 60 micrometers in another aspect, less than 40 micrometers in another aspect, less than 20 micrometers in another aspect, or less than 10 micrometers in another aspect, where the target displacement is a displacement of the target material $11_T$, towards the electron-emitter 12, along a longitudinal-axis $11_L$ of the anode 11, from x-ray powered-off state to stable operation at 40 watts, based on elongation of the anode 11.

Large x-ray tubes can have large pathways for removal of heat, but some x-ray tubes (e.g. for a portable x-ray source) need small size, and can't afford large pathways for removal of heat. It can be more difficult to provide x-ray spot stability in these small x-ray tubes. X-ray tubes are often cooled by a heat exchanger carrying a liquid coolant. Such a cooling method may be impractical for a portable x-ray source.

Therefore, the present invention is especially applicable to small x-ray tubes. Examples of the meaning of "small" include the following:

1. A distance from the electron-emitter 12 to the target material $11_T$ can be less than 60 millimeters in one aspect, less than 40 millimeters in another aspect, or less than 20 millimeters in another aspect.
2. A distance from the x-ray window 14 to a center of the target material $11_T$ can be less than 25 millimeters in one aspect, less than 15 millimeters in another aspect, or less than 10 millimeters in another aspect.
3. A maximum outside diameter of the anode 11 can be less than 15 millimeters in one aspect, less than 10 millimeters in one aspect, less than 7.5 millimeters in another aspect.

A difficulty of small x-ray tubes can be avoiding undesirable short-circuits. The electrical-insulator 15 can be located at least partially inside of a bore 23 extending through heatsink 19. An electrically-conductive adhesive can attach the heatsink 19 to the electrical-insulator 15. A short-circuit between the heatsink 19 and the cathode 13 can be caused by some of this electrically-conductive adhesive extending from the heatsink 19 to the cathode. An annular-groove 18, can be located at an interface of the electrical-insulator 15 and the heatsink 19; can be radially-perpendicular to a longitudinal-axis $11_L$ of the bore 23; can be cut into an inner-face of the heatsink 19, an outer-face of the electrical-insulator 15, or both; and can be configured to contain excess adhesive that binds the electrical-insulator 15 to the heatsink 19. This annular-groove 18 can help avoid a short-circuit between the heatsink 19 and the cathode 13 caused by the electrically-conductive adhesive. The annular-groove 18 can be located at or near an end $23_p$ of the bore that is closest to the electron-emitter 12, such as for example within 3 millimeters of this end $23_p$.

The design of the x-ray tubes 27 and 57 described herein can allow a relatively large voltage differential between the cathode 13 and the anode 11 and can be operated at relatively high power (relative to other, similar-sized, x-ray tubes). The x-ray tubes 27 and 57 can form part of an x-ray source 10, the x-ray source 10 comprising a power supply 24 electrically coupled to the x-ray tube 27 or 57. For example, the x-ray source 10 can provide at least 25 watts of x-ray emission continuously for at least 1 hour.

What is claimed is:

1. An x-ray tube comprising:

a. an anode that is electrically-conductive and that includes a target material configured for production and emission of x-rays in response to impinging electrons;

b. an x-ray window, spaced apart from the target material of the anode and located to allow transmission of the x-rays through the x-ray window and out of the x-ray tube;

c. a cathode, electrically insulated from the anode, and having an electron-emitter capable of emitting electrons towards the target material on the anode;

d. the target material having a target displacement less than 60 micrometers, where the target displacement is a displacement of the target material, towards the electron-emitter, along a longitudinal-axis of the anode, from x-ray powered-off state to stable operation at 40 watts, based on elongation of the anode;

e. an electrical-insulator encircling the anode and electrically insulating the cathode from the anode;

f. a heatsink attached to the electrical-insulator; and g. a straight-line path from an inside of the electrical-insulator, proximate the anode, through the electrical-insulator, through the heatsink to an outer-surface of the heatsink, passes only through materials having a coefficient of thermal conductivity of at least 2.0 W/m*K.

2. The x-ray tube of claim 1, further comprising:

a. the heatsink:

i. having a base proximate the electrical-insulator;

ii. having an array of fins, the array of fins being elongated and extending outwards away from the electrical-insulator in opposite directions with first distal ends at one end and second distal ends at an opposite end;

d. a first fan attached to the first distal ends of the array of fins, oriented to face the base, and configured to direct an airstream towards the base;

e. a second fan attached to the second distal ends of the array of fins, oriented to face away from the base, and configured to draw the airstream from the base;

f. an air flow path extending from the first fan to the second fan within array of fins;

g. a first lateral side of the array of fins extending from the first distal ends to the second distal ends; and h. a first plate located on the first lateral side, having a length of at least 80% of a distance between the first distal ends and the second distal ends, blocking at least 80% of gaps between the fins on the first lateral side, and configured to direct air flow from the first fan to the second fan.

3. The x-ray tube of claim 2, further comprising:

a. a second lateral side of the array of fins extending from the first distal ends to the second distal ends at an opposite side of the array of fins from the first lateral side;

b. a second plate located on the second lateral side, having a length of at least 80% of a distance between the first distal ends and the second distal ends, blocking at least 80% of gaps between the fins on the second lateral side, and configured to direct air flow from the first fan to the second fan.

4. The x-ray tube of claim 1, wherein the x-ray tube forms part of an x-ray source, the x-ray source comprising a power supply electrically coupled to the x-ray tube, wherein the power supply and the x-ray tube can provide at least 25 watts of x-ray emission continuously for at least 1 hour.

5. The x-ray tube of claim 1, wherein a coefficient of linear thermal expansion of at least a portion of the anode is less than 6 μm/(m*K) at 20° C.

6. The x-ray tube of claim 1, wherein the x-ray window is electrically-insulated from the anode and electrically-coupled to the cathode.

7. An x-ray tube comprising:

a. an anode that is electrically-conductive and that includes a target material configured for production and emission of x-rays in response to impinging electrons;

b. an x-ray window, spaced apart from the target material of the anode and located to allow transmission of the x-rays through the x-ray window and out of the x-ray tube;

c. a cathode, electrically insulated from the anode, and having an electron-emitter capable of emitting electrons towards the target material on the anode;

d. the target material having a target displacement less than 60 micrometers, where the target displacement is a displacement of the target material, towards the electron-emitter, along a longitudinal-axis of the anode, from x-ray powered-off state to stable operation at 40 watts, based on elongation of the anode;

e. a distance from the electron-emitter to the target material being less than 40 millimeters;

f. a distance from the x-ray window to a center of the target material being less than 25 millimeters;

g. an electrical-insulator encircling the anode, the electrical-insulator electrically insulating the cathode from the anode;

h. a heatsink:

i. attached to the electrical-insulator;

ii. having a base proximate the electrical-insulator;

iii. having an array of fins, the array of fins being elongated and extending outwards away from the electrical-insulator from proximal ends at the base to distal ends away from the base, and having a height extending between the proximal and distal ends;

i. a fan adjacent to the distal ends of the array of fins and oriented to face the base and configured to direct an airstream towards the base;

j. an air flow path extending from the fan at the distal ends of the array of fins, along the array of fins to the base, and out a first lateral side of the array of fins; and k. a first plate located at the first lateral side of the array of fins and extending from the distal ends of the array of fins towards the base, the first plate having a length of at least 25% of a height of the array of fins and configured to direct air flow from the fan to the base of the heatsink.

8. The x-ray tube of claim 7, wherein the target displacement is less than 20 micrometers.

9. The x-ray tube of claim 7, further comprising a straight-line path, from an inside of the electrical-insulator proximate the anode through the electrical-insulator and through the heatsink to an outer-surface of the heatsink, passes only through materials having a coefficient of thermal conductivity of at least 2.0 W/m*K.

10. The x-ray tube of claim 9, wherein the straight-line path passes only through materials having a coefficient of thermal conductivity of at least 20 W/m*K.

11. The x-ray tube of claim 7, wherein the electrical-insulator is ceramic and there is a distance of less than 1 millimeter between the ceramic electrical-insulator and the heatsink.

12. The x-ray tube of claim 7, further comprising a second plate located at a second lateral side of the array of fins, the second lateral side being opposite of the first lateral side, the second plate extending from the distal ends of the array of fins towards the base, the second plate having a length at least 25% of a height of the array of fins and configured to direct air flow from the fan to the base of the heatsink.

13. The x-ray tube of claim 7, further comprising:

a. the heatsink having a bore extending therethrough, the electrical-insulator located at least partially inside of the bore;

b. an annular-groove:

i. located at an interface of the electrical-insulator and the heatsink and radially-perpendicular to a longitudinal-axis of the bore;

ii. cut into an inner-face of the heatsink, an outer-face of the electrical-insulator, or both; and iii. configured to contain excess adhesive that binds the electrical-insulator to the heatsink.

14. The x-ray tube of claim 13, wherein the annular-groove is located within 3 millimeters of an end of the bore that is closest to the electron-emitter.

15. The x-ray tube of claim 7, wherein a maximum outside diameter of the anode is less than 10 millimeters.

16. The x-ray tube of claim 7, further comprising a hole extending through the electrical-insulator, and wherein:

a. the anode extends through the hole in the electrical-insulator;

b. the electrical-insulator electrically insulates the cathode from the anode;

c. a hermetic-bond of the electrical-insulator to the anode is located within 3 millimeters of a proximal-end of the hole closer to the electron-emitter.

17. The x-ray tube of claim 16, wherein a distance between the center of the target material of the anode and the proximal-end of the hole of the electrical-insulator is less than 10 millimeters.

18. An x-ray tube comprising:

a. an anode that is electrically-conductive and that includes a target material configured for production and emission of x-rays in response to impinging electrons;

b. a cathode, electrically insulated from the anode, and having an electron-emitter capable of emitting electrons towards the target material on the anode;

c. a heatsink having a base located closer to the anode and an array of fins extending from the base away from the anode in opposite directions with first distal ends at one end and second distal ends at an opposite end;

d. a first fan attached to the first distal ends of the array of fins, oriented to face the base, and configured to direct an airstream towards the base;

e. a second fan attached to the second distal ends of the array of fins, oriented to face away from the base, and configured to draw the airstream from the base;

f. an air flow path extending from the first fan to the second fan within array of fins;

g. a first lateral side of the array of fins extending from the first distal ends to the second distal ends;

h. a first plate located on the first lateral side, having a length of at least 80% of a distance between the first distal ends and the second distal ends, blocking at least 80% of gaps between the fins on the first lateral side, and configured to direct air flow from the first fan to the second fan;

i. a second lateral side of the array of fins extending from the first distal ends to the second distal ends and located at an opposite side of the array of fins from the first lateral side; and j. a second plate located on the second lateral side, having a length of at least 80% of a distance between the first distal ends and the second distal ends, blocking at least 80% of gaps between the fins on the second lateral side, and configured to direct air flow from the first fan to the second fan.

19. The x-ray tube of claim 18, further comprising:

a. an electrical-insulator encircling the anode and electrically insulating the cathode from the anode;

b. the heatsink attached to the electrical-insulator; and c. a straight-line path from an inside of the electrical-insulator, proximate the anode, through the electrical-insulator, through the heatsink to an outer-surface of the heatsink, passes only through materials having a coefficient of thermal conductivity of at least 2.0 W/m*K.

20. The x-ray tube of claim 19, wherein the straight-line path passes only through materials having a coefficient of thermal conductivity of at least 20 W/m*K.

* * * * *